US011460231B2

(12) United States Patent
Van Den Berg

(10) Patent No.: US 11,460,231 B2
(45) Date of Patent: Oct. 4, 2022

(54) DEVICE FOR CONTROLLING THE TEMPERATURE OF AN EXTERNAL FLUID, AN OPERATING METHOD THEREOF, AND A COMPUTER PROGRAM PRODUCT COMPRISING SUCH METHOD INSTRUCTIONS

(71) Applicant: HC United B.V., Waardenburg (NL)

(72) Inventor: Joseph Martinus Maria Van Den Berg, Tiel (NL)

(73) Assignee: HC United B.V., Waardenburg (NL)

( * ) Notice: Subject to any disclaimer, the term of this patent is extended or adjusted under 35 U.S.C. 154(b) by 92 days.

(21) Appl. No.: 16/977,223

(22) PCT Filed: Feb. 27, 2019

(86) PCT No.: PCT/EP2019/054818

§ 371 (c)(1),
(2) Date: Sep. 1, 2020

(87) PCT Pub. No.: WO2019/170486

PCT Pub. Date: Sep. 12, 2019

(65) Prior Publication Data

US 2021/0010729 A1 Jan. 14, 2021

(30) Foreign Application Priority Data

Mar. 6, 2018 (EP) ..... 18160243

(51) Int. Cl.
*F25B 49/02* (2006.01)
*F25B 41/20* (2021.01)
*F25B 41/22* (2021.01)

(52) U.S. Cl.
CPC ..... *F25B 49/02* (2013.01); *F25B 41/20* (2021.01); *F25B 41/22* (2021.01);
(Continued)

(58) Field of Classification Search
CPC ..... F25B 41/20; F25B 41/24; F25B 41/26; F25B 41/28; F25B 49/02; F25B 2339/047;
(Continued)

(56) References Cited

U.S. PATENT DOCUMENTS 4,238,933 A 12/1980 Coombs
7,648,475 B2 * 1/2010 De Cicco ..... G01K 1/143 210/741
(Continued)

FOREIGN PATENT DOCUMENTS

EP 1923647 A1 5/2008
FR 2938440 A1 * 5/2010 ..... A61M 1/36
(Continued)

OTHER PUBLICATIONS

International Search Report (ISR) for PCT/EP2019/054818 dated Apr. 2, 2019 (3 pages).
(Continued)

*Primary Examiner* — Miguel A Diaz
(74) *Attorney, Agent, or Firm* — Shumaker, Loop & Kendrick, LLP

(57) ABSTRACT

A device for controlling the temperature of an external fluid. The device including a compressor for compressing an internal fluid, a first heat exchanger in a temperature control circuit for transferring thermal energy between the internal fluid and the external fluid. The device is further configured for use within a system for controlling the temperature of blood.

12 Claims, 3 Drawing Sheets

(52) U.S. Cl.
CPC . *F25B 2339/047* (2013.01); *F25B 2400/0401* (2013.01); *F25B 2600/2501* (2013.01); *F25B 2700/21161* (2013.01)

(58) Field of Classification Search
CPC ..... F25B 2400/04; F25B 2400/0401; F25B 2400/0403; F25B 2400/0409; F25B 2600/2501; F25B 2600/2507; F25B 2700/21161
See application file for complete search history.

(56) References Cited

U.S. PATENT DOCUMENTS 7,886,549 B2 * 2/2011 Kawakatsu ..... F25B 49/027 62/197
8,220,531 B2 * 7/2012 Murakami ..... F25B 13/00 165/240
9,285,137 B2 * 3/2016 Peters ..... F24H 9/00
9,383,126 B2 * 7/2016 Chen ..... F25B 49/02
10,124,104 B2 * 11/2018 Cho ..... A61M 1/3468
10,208,966 B2 * 2/2019 Robinson ..... F24D 19/1054
2013/0136431 A1 * 5/2013 Peters ..... F24H 9/00 392/308
2017/0143887 A1 * 5/2017 Cho ..... A61M 1/3472
2020/0330263 A1 * 10/2020 Dabrowiak ..... H02J 7/0042
2021/0196504 A1 * 7/2021 Jeong ..... A61F 7/00

FOREIGN PATENT DOCUMENTS

WO 2014101662 A1 7/2014
WO 2014106030 A1 7/2014

OTHER PUBLICATIONS

Written Opinion of the International Search Authority for PCT/EP2019/054818 dated Apr. 2, 2019 (7 pages).

* cited by examiner

DEVICE FOR CONTROLLING THE TEMPERATURE OF AN EXTERNAL FLUID, AN OPERATING METHOD THEREOF, AND A COMPUTER PROGRAM PRODUCT COMPRISING SUCH METHOD INSTRUCTIONS

TECHNICAL FIELD AND BACKGROUND

The invention relates to a device for controlling the temperature of an external fluid, wherein the device comprises a compressor for compressing an internal fluid, and a first heat exchanger in a temperature control circuit for transferring thermal energy between the internal fluid and the external fluid.

SUMMARY

The invention also relates to a system for controlling the temperature of blood.

In devices for controlling the temperature of an external fluid it is known to start and stop the compressor operation dependent on the desired transfer of thermal energy between an internal fluid of the device and an external fluid. A drawback of the start and stop operation of the compressor is that it requires time before the compressor is in full operation again from a stopped operation state. This delay has the result that the temperature of the external fluid cannot be accurately controlled. Further, on and off operation of the compressor is undesired for a number of reasons including for example higher wear which may result in relatively small maintenance intervals.

It is a primary object of the present invention to provide a device for controlling the temperature of an external fluid in a relatively accurate manner. In addition, it is a secondary object to provide a relatively reliable device for controlling the temperature of an external fluid, preferably having a relatively simple structure.

At least one of these objects is achieved with the device disclosed herein.

The device for controlling the temperature of an external fluid comprises a compressor for compressing an internal fluid, a first heat exchanger in a temperature control circuit for transferring thermal energy between the internal fluid and the external fluid, a second heat exchanger connected, preferably in parallel with the compressor, between an inlet and an outlet of the compressor in a bypass circuit, and a controller configured to control the temperature of the external fluid by switching at least one valve between a closed position and an open position and vice versa, wherein in the closed position of the at least one valve the internal fluid from the compressor is directed from the outlet of the compressor via the second heat exchanger to the inlet of the compressor and in the open position of the at least one valve the internal fluid is directed from the outlet of the compressor to the first heat exchanger.

The device for controlling the temperature of an external fluid has at least two modes, i.e. a first mode wherein the external fluid is heated or cooled by the thermal energy transfer between the internal fluid and the external fluid and a second mode wherein by-passing the first heat exchanger in the temperature control circuit enables the compressor to run continuously without starting and stopping the compressor, or even without otherwise disturbing the compressor operation. In the second mode there is no or minimal thermal energy transfer between the internal fluid and the external fluid, because the internal fluid from the outlet of the compressor is no longer directed to the first heat exchanger. The second mode can be selected by the controller if no (more) energy transfer between the internal fluid and the external fluid is desired. Stopping the energy transfer can be desired if the external fluid has reached its desired temperature and no further heating/cooling is required. Thus, the operation of the compressor in the second mode may be continuous without any risk of damaging for example by overheating the compressor, because by using the second heat exchanger the temperature of the internal fluid can be lowered between the outlet of the compressor and the inlet of the compressor. Further, if there is a sudden demand to adjust the temperature of the external fluid, the compressor may respond almost instantaneously by switching from the second mode to the first mode, such that it is possible to control the temperature of the external fluid in a relatively accurate manner without significant delay. Preferably, if the temperature must be kept constant at a predetermined temperature, the temperature difference between the actual temperature of the external fluid and the desired temperature of the external fluid is 0.2° C. or smaller, preferably 0.1° C. or smaller.

In addition, the components used in the device for controlling the temperature of an external fluid are relatively reliable, i.e. the device uses a controller controlling at least one valve between an open position, i.e. the above described first mode of the device, and a closed position, i.e. the above described second mode of the device, and vice versa.

In a further aspect, the device may comprise a first valve positioned between an outlet of the compressor and the first heat exchanger, and a second valve positioned between the first valve and an inlet of the compressor, and the controller is configured to control the temperature of the external fluid by switching the second valve between the closed position and the open position and vice versa, wherein in the closed position of the second valve the internal fluid from the compressor is directed from the outlet of the compressor via the second heat exchanger to the inlet of the compressor and in the open position of the second valve the internal fluid is directed from the outlet of the compressor via the first valve to the first heat exchanger and back via the first valve and the second valve to the inlet of the compressor. After passing the second valve, the internal fluid may be directed directly to the inlet of the compressor. In a second configuration, the internal fluid may after passing the second valve, be directed via the second heat exchanger to the inlet of the compressor. This second configuration ensures, independent of the mode of the device, that the conditions of the internal fluid entering the compressor through the inlet of the compressor can be controlled by means of the second heat exchanger, such that the conditions may be kept constant or substantially constant, for example within a predetermined temperature range or at a predetermined temperature. In other words, the conditions of the internal fluid entering the compressor can be controlled by means of the second heat exchanger in the first mode of the device and in the second mode of the device. One important condition of the internal fluid to be controlled is for example the temperature of the internal fluid, i.e. a relatively high or relatively low temperature of the internal fluid entering the compressor provides a higher risk of damaging the compressor.

This configuration of the device using a second valve positioned between the first valve and an inlet of the compressor further optimizes the respond time of the device and/or further minimizes the risk that the compressor will be overheated/damaged in the closed position of the second valve.

The device further may further comprise a third heat exchanger in the temperature control circuit arranged between the compressor and the first heat exchanger.

The third heat exchanger provides a device having three modes, i.e. a first mode for heating the external fluid, a second by-pass mode as described above and a third mode for cooling the external fluid. In a relatively simple configuration of the device the first valve is a four-way-valve which enables the device to switch in a reliable and fast manner between the first mode and the third mode of the device.

The controller may be configured to switch the four-way valve between a heating modus (first mode) and a cooling modus (third mode), wherein in the cooling modus the external fluid is cooled by the internal fluid in the first heat exchanger, and in the heating modus the external fluid is heated by the internal fluid in the first heat exchanger.

In the heating modus internal fluid from the outlet of the compressor is directed via the four-way valve, the first heat exchanger, an expansion throttle, the third heat exchanger, the four-way valve and the second valve to the inlet of the compressor, wherein in the cooling modus internal fluid from the outlet of the compressor is directed via the four-way valve, the third heat exchanger, an expansion throttle, the first heat exchanger, the four-way valve and the second valve to the inlet of the compressor.

The device as disclosed herein can be used in various applications, including, but not limited to industrial processes requiring an accurate temperature control, room temperature control, in particular temperature control of clean rooms. It is also possible to use/implement the device described herein in food technology and processing. For example, the device for controlling the temperature of an external fluid is used to exchange thermal energy between the temperature controlled external fluid and a food product. It is also possible that the external fluid is the food product. An example is a 3D chocolate printer where accurate temperature control of the chocolate is important. The device as disclosed in this document may also be applied in (scientific) material processing requiring an accurate temperature control, for example in an extruder for preparing a sample under specific temperature conditions. Further, the device as specified in this specification can be used for temperature control in a process for preparing pharmaceutical products.

The device according to the invention is particularly suited to be used in a system for controlling the temperature of blood. As described above, the device is able to control the temperature of the external fluid in a highly accurate manner which is prerequisite for handling blood outside a body. The device can be used in the system as an integral for cardiopulmonary bypass operations and/or for extracorporeal membrane oxygenation (ECMO) or extracorporeal life support. The temperature difference between the external fluid, for example water, that can circulated by the system and the blood determines energy (heat) transfer and regulates the temperature of the blood perfusing the patient.

By means of the device disclosed herein conventional warm and cold water tanks to deliver temperature-controlled water may be omitted in the medical system. The system is provided with a water (or a water solution) outlet and/or inlet and a sensor for detecting the presence of water (or a water solution) in the system, for example after using the system. The outlet and the inlet may be the same. After using the system, for example after surgery, the water should be preferably discharged from the system by the discharge outlet. Using fresh water in the system for each surgery reduces the bacterial load in the system and the associated risks such as for example the risk of *M. chimaera* and/or legionella infections. This discharge-step can be monitored by a sensor. This sensor can be automatically activated, for example when the device is switched off by an operator. If there is water in the system, the operator will be warned for example by an alarm activated by the sensor. Then, the operator is able to perform the step of discharging water from the system.

The invention also relates to a method for operating a device for controlling the temperature of an external fluid or a system as described herein and to a computer program product, comprising a readable storage medium, comprising instructions which, when executed on at least one processor, cause the at least one processor to carry out the method.

BRIEF DESCRIPTION OF THE DRAWINGS

The invention will now be explained in more detail with reference to the drawings and by means of a description of a number of exemplary embodiments of the device for controlling the temperature of an external fluid and an exemplary embodiment of the system for controlling the temperature of blood, wherein.

DETAILED DESCRIPTION

Figure 1:
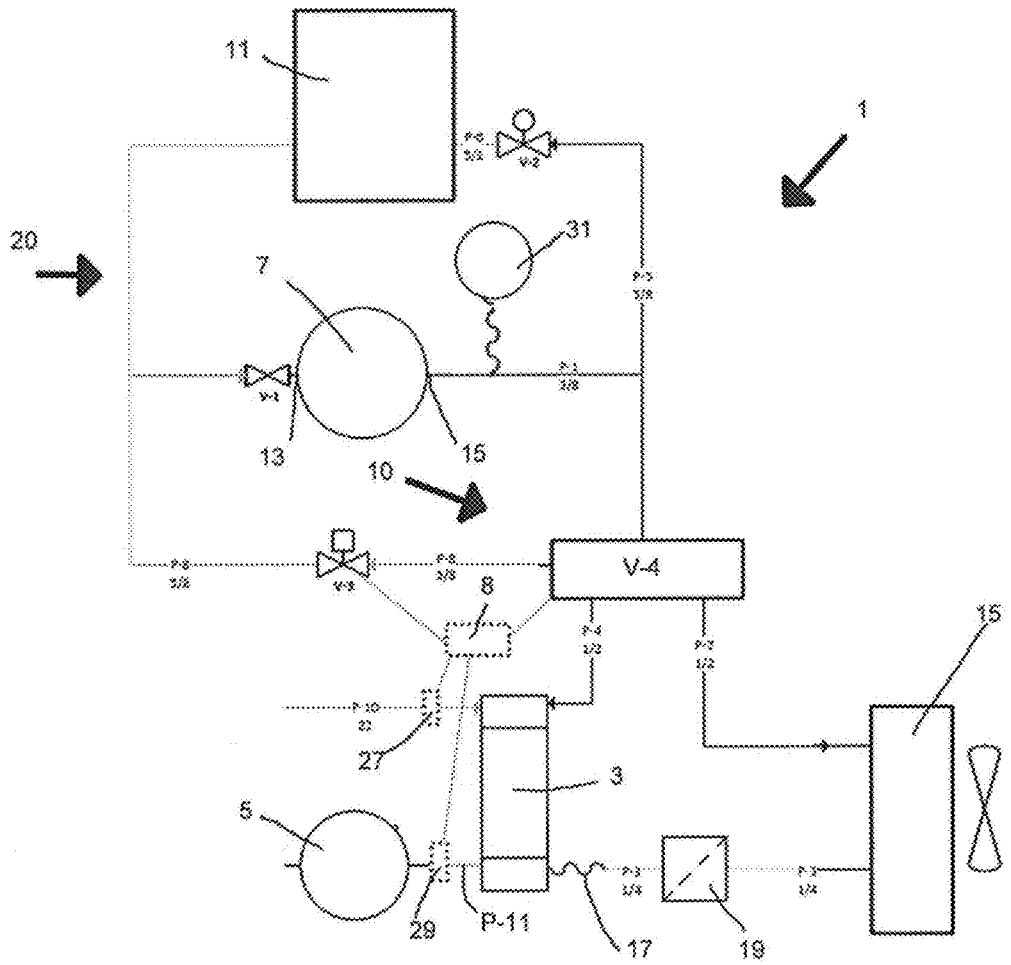
FIG. 1 shows a schematic view of the device for controlling the temperature of an external fluid.

In FIG. 1 a device 1 is schematically shown for controlling the temperature of an external fluid. The external fluid flows through line P-10 into a first heat exchanger 3 and out the first heat exchanger 3 through line P11. The external fluid is a liquid and in line P11 a pump 5 is provided to transport the liquid.

The device 1 comprises a compressor 7 for compressing an internal fluid. The internal fluid is able to flow through the internal fluid lines P-1-P-6 and P-8. The internal fluid is a gas.

The first heat exchanger 3 is located in a temperature control circuit 10. The first heat exchanger 3 is configured for transferring thermal energy, for example heat, between the internal fluid and the external fluid.

The device 1 further comprises a second heat exchanger 11 connected in parallel with the compressor 7 between an inlet 13 and an outlet 15 of the compressor 7 in a bypass circuit 20. The device 1 also comprises a controller 8.

In addition, the device 1 comprises a first valve V-4 positioned between the outlet 15 of the compressor and the first heat exchanger 3, and a second valve V-3 positioned between the first valve V-4 and the inlet 13 of the compressor.

The controller 8 is configured to control the temperature of the external fluid by switching the second valve V-3 between a closed position (second mode) and an open position (first mode) and vice versa. In the closed position of the second valve V-3 the internal fluid from the compressor 7 is directed directly from the outlet 15 of the compressor 7 via the second heat exchanger 11 to the inlet 13 of the compressor 7, wherein in the open position of the second valve V-3 the internal fluid is directed from the outlet 15 of the compressor 7 via the first valve V4 to the first heat exchanger 3.

In this configuration of the device accurate temperature control of the external fluid can be achieved with minimal risk of overheating the compressor 7. The risk of overheating the compressor 7 is reduced by using the second heat exchanger 11, wherein the fluid coming directly from the compressor 7 is cooled. Hence, the operation of the compressor 7 in the second mode may be continuous without any risk of overheating the compressor 7.

The first valve V-4 is a four-way-valve V-4. The device 1 further comprises a third heat exchanger 15 in the temperature control circuit 10 arranged between the compressor 7 and the first heat exchanger 3. The four-way-valve V-4 is connected with line P-4 to the first heat exchanger 3 and with a separate line P-2 to the third heat exchanger 15. The first heat exchanger 3 and the third heat exchanger 15 are connected with line P-3. In line P-3 there is provided an expansion throttle 17, and a conditioner unit (a filter) 19 for conditioning the internal fluid to be transported to first heat exchanger 3 or to the third heat exchanger 15 depending on the modus, i.e. heating modus or cooling modus as explained below.

The controller 8 of the device is configured to switch the four-way valve V-4 between a heating modus and a cooling modus, wherein in the cooling modus the external fluid is cooled by the internal fluid in the first heat exchanger 3, and in the heating modus the external fluid is heated by the internal fluid in the first heat exchanger 3. In the heating modus internal fluid from the outlet 15 of the compressor 7 is directed via the four-way valve V-4, the first heat exchanger 3, the expansion throttle 17, and the filter 19, the third heat exchanger 15, the four-way valve V-4 and the second valve V-3 to the inlet 13 of the compressor. In the cooling modus internal fluid from the outlet 15 of the compressor 7 is directed via the four-way valve V-4, the third heat exchanger 15, the expansion throttle 17, the first heat exchanger 3, the four-way valve V-4 and the second valve V-3 to the inlet 13 of the compressor 7.

As shown in FIG. 1 by the dotted lines the controller 8 is able to control the second valve V-3. Further, the controller 8 is able to control the four-way valve V-4. In addition, the controller 8 may be connected to at least one of the sensors 27, 29 measuring the temperature of the external fluid in line P-10 flowing into the first heat exchanger 3 and/or the temperature of the external fluid flowing out of the heat exchanger 4 through line P-11.

The device 1 further comprises an additional valve V-2 positioned between lines P-5 and P-6 connecting the outlet 15 of the compressor 7 and the inlet of the second heat exchanger 11. After shutting the second valve V-3, the additional valve V-2 is automatically opened from a closed position to an open position by pressure difference caused by shutting the second valve V-3. If the second valve V-3 is opened, the second valve V-3 is closed automatically by the pressure difference.

It is also possible that the controller 8 is configured (not shown in FIG. 1) to open the additional valve V-2 upon closing the second valve V-3 and to close the additional valve V-2 upon opening the second valve V-3, such that the additional valve V-2 is not operated by pressure.

The device 1 can also be provided with an overpressure protection 31.

Instead of the one-way second valve V-3, it may also be possible to use at least one three-way valve (not shown) on the crossing between line P-1 and P-5 to switch between the bypass mode and an energy transfer mode. This three-way valve is controlled by a controller, for example the controller 8 as shown in FIG. 1. It is also possible to use a second three-way valve (not shown) on the crossing between line P-8 and the line comprising a valve V-1. The second three-way valve may also be operated by the controller.

Valve V-1 is used to close line P-8, for example for maintenance of the compressor 7 or for replacing the compressor 7.

The device 1 shown in FIG. 1 is configured to perform three modes, i.e. a heating modus, a cooling modus and a bypass modus.

It is also possible that the device is configured for two modes, i.e. a heating modus or a cooling modus and a bypass modus.

The external fluid of the device for controlling the temperature of an external fluid may be a fluid, for example blood as to be discussed below, which requires temperature control for a specific application, i.e. direct temperature control, or the external fluid is a fluid for controlling the temperature of another external product, i.e. indirect temperature control.

Figure 2:
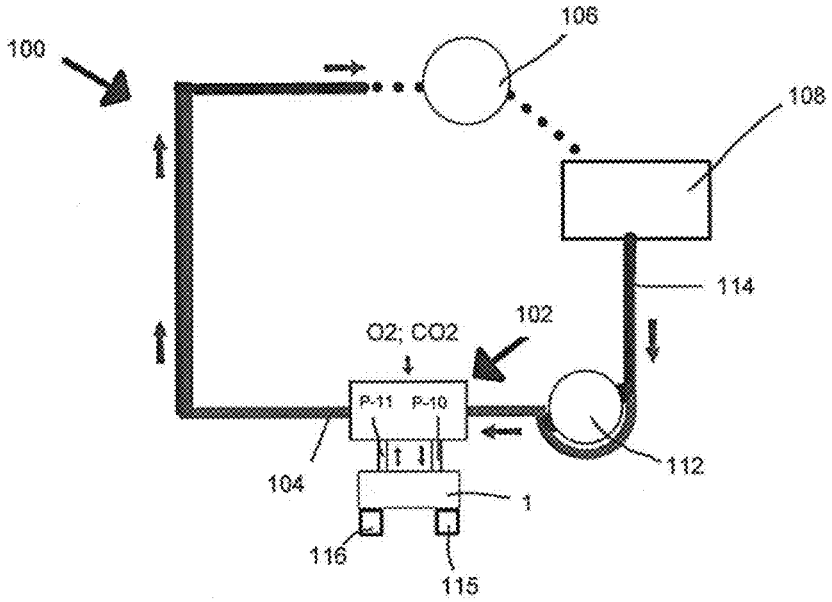
FIG. 2 shows a schematic view of a system for controlling the temperature of blood.

In FIG. 2 as an example a system 100 for controlling the temperature of blood is shown. The system 100 comprises the device 1 as explained above and shown in more detail in FIG. 1. The lines P-10, P-11 are connected to an oxygenator 102, i.e. a device capable of exchanging for example oxygen and/or carbon dioxide in the blood of human patient during surgical procedures that may necessitate the interruption or cessation of blood flow in the body, a critical organ or great blood vessel. An oxygenator is a gas exchanger because besides oxygen and/or carbon dioxide it also possible to transport anaesthetics, and possibly other gases into and out of the circulation. The device 1 may be integrated in the oxygenator 102. Further, the oxygenator's gas exchange function may be omitted (not shown in FIG. 2) in the light of the present invention as long as the temperature of the blood can be controlled by the device 1

In FIG. 2, the blood line 104 transports the blood conditioned by the oxygenator 102 to, for example the great vessels 106 of a person undergoing surgery, wherein the blood temperature of the blood flowing outside the person's body is accurately maintained at the desired temperature by means of the device 1. The blood to be treated may be collected in a reservoir 108 and transported to the oxygenator 102 and the device 1 by means of blood line 114 and pump 112. The dotted lines in the embodiment shown in FIG. 2 between the blood line 104 and the great vessels 106 and the great vessels 106 and the reservoir 108 indicate that these lines may partly run inside the person's body.

In the embodiment shown, the temperature of blood is controlled by controlling the temperature of the external fluid, preferably the external fluid is water or a water solution.

The system 100, in particular the device 1 comprises an external fluid outlet/inlet 115 and a sensor (not shown) for detecting the presence of the water in the device 1, for example in lines P-10 and P-11.

The sensor is connected to an alarm unit 116 which may inform the operator at the end of the surgery that the water should be removed from the system 100.

The sensor may automatically be switched on when the device 1 is switched off. Alternatively, the sensor may also be activated when no thermal transfer between the internal fluid of the device 1 and the water has occurred for a predetermined time period. Then, the activated sensor detects if water is present in the device 1, for example in the lines P-10 and P-11. If water is present the sensor activates the alarm unit 116 to inform the operator to discharge the water if possible. The alarm signal may be shown on a display (not shown) of the device 1.

Figure 3:
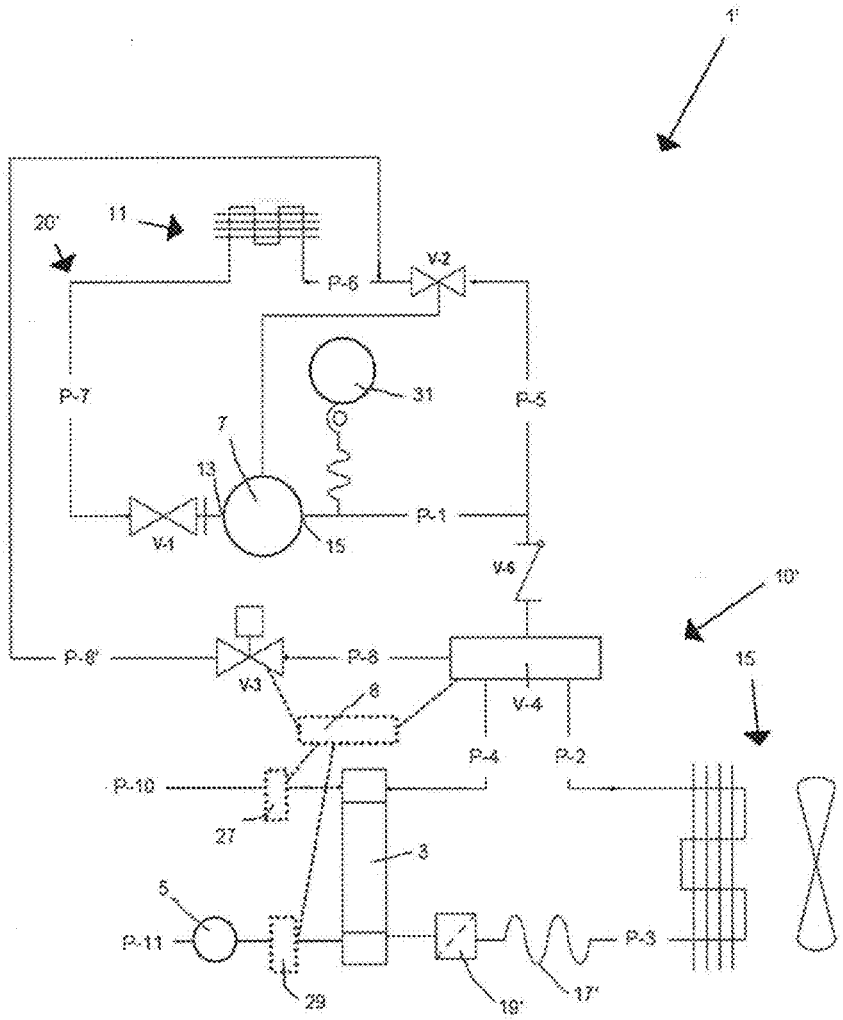
FIG. 3 shows a schematic view of a second embodiment of the device for controlling the temperature of an external fluid.

In FIG. 3 a schematic view of a second embodiment of the device 1' for controlling the temperature of an external fluid is shown. Many components of the device 1' are identical to the components of the device 1, and corresponding components are provided with identical reference signs in FIGS. 1 and 3. For the sake of brevity these corresponding components will not be repeated here. The main difference of the device 1' with respect to device 1 is that line P-8' connects the second valve V-3 with the inlet of the second heat exchanger 11, in the example shown via line P-6. In this configuration, in an open position (first mode) of the second valve V-3, it is possible to condition the internal fluid flowing from the second valve V-3 to the inlet 13 of the compressor 7 by means of the second heat exchanger 11. As a result, the conditions of the internal fluid such as temperature can be controlled by means of the second heat exchanger 11, e.g. can kept relatively constant independent in which (first, second or third) modus or mode the device 1' is operated. For example, the second heat exchanger 11 may lower or rise the temperature of the internal fluid flowing to the inlet 13 of the compressor 7 which facilitates preventing that the compressor 7 will be damaged by the internal fluid having a relatively high or relatively low temperature.

As shown in FIG. 3, the second heat exchanger 11 is connected by means of line P-7, via valve V-1, with the inlet 13 of the compressor 13.

The bypass circuit 20' of the device 1' is provided by the compressor 7, lines P-1, P-5, valve V-2, line P-6, the second heat exchanger 11 which is connected in parallel with the compressor 7, line P-7 and valve V-1 connected to the inlet 13 of the compressor 7.

Between the first valve V4 and the crossing between line P-1 and P-5, the device 1' comprises a non-return valve V-6. This non-return valve V-6 can also be used in the device 1 shown in FIG. 1 between the first valve V4 and the crossing between line P-1 and P-5.

Further, in line P-3 of the temperature control circuit 10' the expansion throttle (or capillary) 17' and the conditioner unit (a filter dryer) 19' shown in FIG. 3 are arranged in a different order than in FIG. 1. However, the arrangement shown in FIG. 1 of the expansion throttle 17 and the conditioner unit (a filter dryer) 19 can also be used in FIG. 3 or vice versa.

The controller 8 of the device 1' is configured to switch the four-way valve V-4 between a heating modus and a cooling modus in the same manner as device 1 shown in FIG. 1, wherein in the heating modus internal fluid from the outlet 15 of the compressor 7 is directed via the four-way valve V-4, the first heat exchanger 3, the filter 19', the expansion throttle 17', the third heat exchanger 15, the four-way valve V-4, line P-8', the second valve V-3, the second heat exchanger 11, the line P-7 and valve V-1 to the inlet 13 of the compressor 7. In the cooling modus internal fluid from the outlet 15 of the compressor 7 is directed via the four-way valve V-4, the third heat exchanger 15, the expansion throttle 17', the filter 19', the first heat exchanger 3, the four-way valve V-4, line P-8', the second valve V-3, the second heat exchanger 11, the line P-7 and valve V-1 to the inlet 13 of the compressor 7.

The invention claimed is:

1. A device for controlling the temperature of an external fluid, wherein the device comprises a compressor for compressing an internal fluid, a first heat exchanger in a temperature control circuit for transferring thermal energy between the internal fluid and the external fluid, a second heat exchanger connected between an inlet and an outlet of the compressor in a bypass circuit, and a controller configured to control the temperature of the external fluid by switching at least one valve between a closed position and an open position and vice versa, wherein in the closed position of the at least one valve the internal fluid from the compressor is directed from the outlet of the compressor via the second heat exchanger to the inlet of the compressor and in the open position of the at least one valve the internal fluid is directed from the outlet of the compressor to the first heat exchanger, wherein the at least one valve of the device comprises a first valve positioned between the outlet of the compressor and the first heat exchanger, and a second valve positioned between the first valve and the inlet of the compressor, and the controller is configured to control the temperature of the external fluid by switching the second valve between the closed position and the open position and vice versa, wherein in the closed position of the second valve the internal fluid from the compressor is directed from the outlet of the compressor via the second heat exchanger to the inlet of the compressor and in the open position of the second valve the internal fluid is directed from the outlet of the compressor via the first valve to the first heat exchanger and back via the first valve and the second valve to the inlet of the compressor.

2. The device according to claim 1, wherein the device further comprises a third heat exchanger in the temperature control circuit arranged between the compressor and the first heat exchanger.

3. The device according to claim 1, wherein, in the second heat exchanger, the fluid from the compressor is cooled.

4. The device according to claim 1, wherein the device further comprises an additional valve positioned between the outlet of the compressor and the inlet of the second heat exchanger.

5. The device according to claim 4, wherein the controller is configured to open the additional valve upon closing the second valve and to close the additional valve upon opening the second valve.

6. The device according to claim 4, wherein the additional valve is pressure controlled.

7. The device according to claim 1, wherein the first valve is a four-way-valve.

8. The device according to claim 7, wherein the controller is configured to switch the four-way valve between a heating modus and a cooling modus, wherein in the cooling modus the external fluid is cooled by the internal fluid in the first heat exchanger, and in the heating modus the external fluid is heated by the internal fluid in the first heat exchanger.

9. The device according to claim 8, wherein in the heating modus internal fluid from the outlet of the compressor is directed via the four-way valve, the first heat exchanger, an expansion throttle, the third heat exchanger, the four-way valve and the second valve to the inlet of the compressor, wherein in the cooling modus internal fluid from the outlet of the compressor is directed via the four-way valve, the third heat exchanger, the expansion throttle, the first heat exchanger, the four-way valve and the second valve to the inlet of the compressor.

10. A system for controlling the temperature of blood comprising the device according to claim 1.

11. The system according to claim 10, wherein the temperature of blood is controlled by controlling the temperature of the external fluid.

12. The system according to claim 11, wherein the system comprises an external fluid outlet and/or inlet and a sensor for detecting the presence of the external fluid in the system.

* * * * *